US007255057B2

(12) United States Patent
Wright

(10) Patent No.: US 7,255,057 B2
(45) Date of Patent: Aug. 14, 2007

(54) RAMP FOR PONTOON BOAT

(76) Inventor: William C. Wright, 6665 Crestwood Peninsula, Flowery Branch, GA (US) 30542

( * ) Notice: Subject to any disclaimer, the term of this patent is extended or adjusted under 35 U.S.C. 154(b) by 0 days.

(21) Appl. No.: 11/085,301

(22) Filed: Mar. 21, 2005

(65) Prior Publication Data

US 2005/0160962 A1 Jul. 28, 2005

Related U.S. Application Data

(63) Continuation-in-part of application No. 10/431,021, filed on May 7, 2003, now Pat. No. 6,868,799.

(51) Int. Cl.
*B63B 17/00* (2006.01)
*B63B 25/06* (2006.01)

(52) U.S. Cl. ..... 114/362; 114/162

(58) Field of Classification Search ..... 114/343, 114/362, 162, 172, 242, 246, 132, 138, 130
See application file for complete search history.

(56) References Cited

U.S. PATENT DOCUMENTS 421,008 A * 2/1890 Martin ..... 114/129
433,955 A * 8/1890 McPartland ..... 114/129
2,809,496 A * 10/1957 Geil ..... 405/2
5,085,165 A * 2/1992 Reed ..... 114/362
6,264,518 B1 * 7/2001 Price ..... 440/91
6,868,799 B2 * 3/2005 Wright ..... 114/343

* cited by examiner

*Primary Examiner*—Sherman Basinger
(74) *Attorney, Agent, or Firm*—Harry I. Leon; Vivian L. Steadman

(57) ABSTRACT

A ramp for a pontoon boat on which a boat user can come and go from it without having to get wet. Rotatably attached to the outboard end of the ramp is a cylindrical float which not only keeps the ramp and user afloat but also acts like a roller enabling the ramp to move up on the shore during docking on a typical beach. The ramp includes a support structure attached in most cases to the underside of the boat and a platform slideably connected to the support structure. Rotatably attached to the inboard end of the platform is a rudder which can be turned approximately 90 degrees to the centerline of the ramp. When the rudder is so turned and the boat is in motion, water drag forces acting on the rudder cause the platform to be either extended or retracted relative to the support structure.

8 Claims, 8 Drawing Sheets

RAMP FOR PONTOON BOAT

RELATED U.S. APPLICATION DATA

This is a continuation-in-part application of a application having Ser. No. 10/431,021 and a filing date of May 7, 2003 now U.S. Pat. No. 6,868,799.

BACKGROUND OF THE INVENTION

The previous application disclosed a floatable ramp for a pontoon boat in which the ramp can be alternately extended or retracted by one of two methods: either manually or with the use of an electric motor. An alternate method in which a rudder is used to extend and retract the ramp is disclosed herein.

SUMMARY OF INVENTION

The primary object of the present invention is to provide a floatable ramp for a pontoon boat, or the like, across which a boat user can come and go, without having to get wet.

A further object of this invention is to provide such a ramp which can be used to assist swimmers as they enter or leave the boat.

A further object of this invention is to provide a ramp which, while it is projecting from the boat, can be moved easily up and onto a typical beach, thereby facilitating docking.

A still further object of this invention is to facilitate access to the boat by a handicapped person.

A still further object is to provide a novel method of moving the ramp without the need for manual or electrical power.

An improved ramp assembly comprises a ramp platform (hereinafter referred to as "ramp") and a support structure which is attachable, in most instances, to the underside of a pontoon boat. The ramp is slideably connected to the support structure by a shaft which terminates in a pair of bearing blocks in a grooved bearing structure. As the ramp is being extended outwardly from or, alternately, retracted into the support structure, the bearing blocks ride on elongated bearing surface tracks mounted within the support structure.

A cylindrical float, rotatably mounted on the free end of the ramp, has sufficient buoyancy to support it, as well as a user, when the ramp is fully extended. The cylindrical float not only keeps the ramp afloat but also acts like a wheel during docking, enabling one to move the ramp, in its extended position, up and onto the shore at most beaches.

Means for extending and retracting the platform comprises an activation rudder rotatably mounted on the platform down-wardly of its inboard end. The platform is extended by releasing a lock, turning the activation rudder so that the face of the rudder is disposed at approximately 90 degrees to the direction of motion of the boat and then moving the boat in a direction away from the outboard end of the extending ramp.

To store the platform on the underside of the pontoon boat, one again turns the activation rudder so that the face of the rudder is disposed at approximately 90 degrees to the longitudinal centerline of the boat; with the rudder so disposed, the boat is then moved in a direction toward the outward end of the ramp.

The ramp lock can be released by pulling a rope or cable that is attached to control arm from any convenient location in the boat.

DETAILED DESCRIPTION OF THE PREFERRED EMBODIMENT

Figure 1:
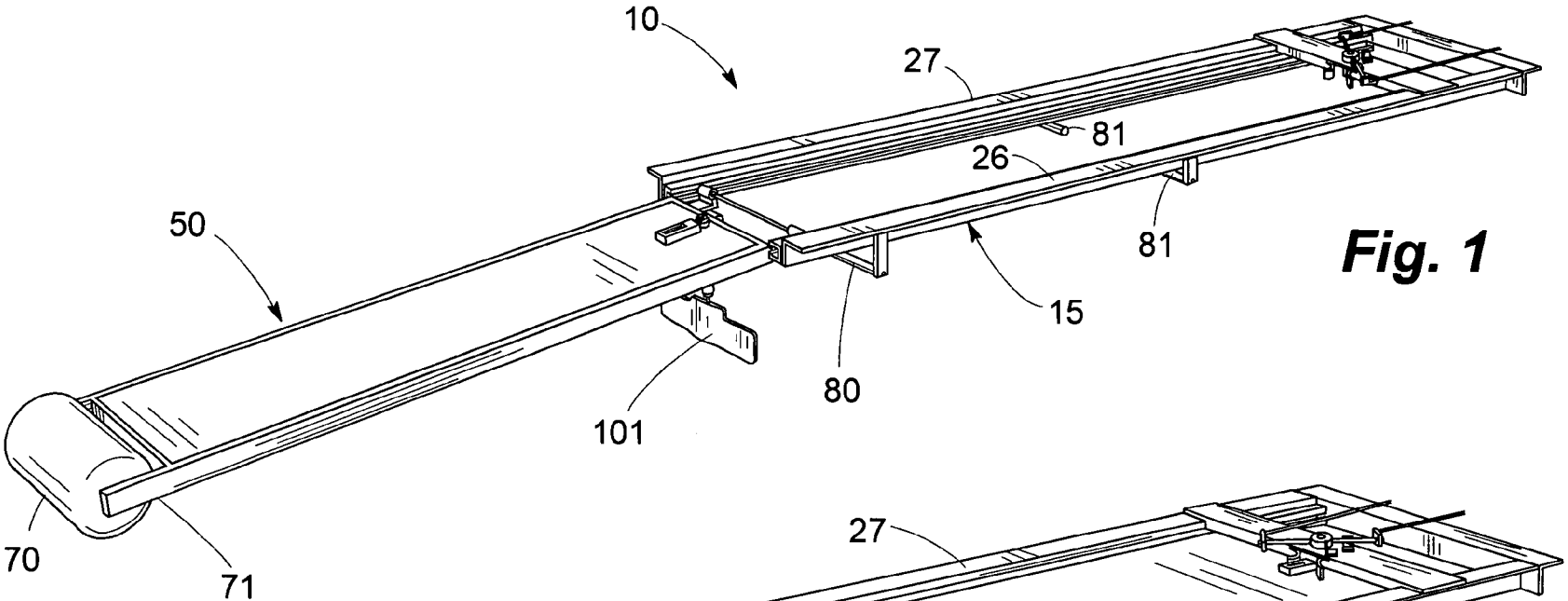
FIGS. 1 and 2 are right side perspective views of the improved ramp assembly with the ramp in its extended and retracted positions, respectively, relative to its support structure.
Figure 2:
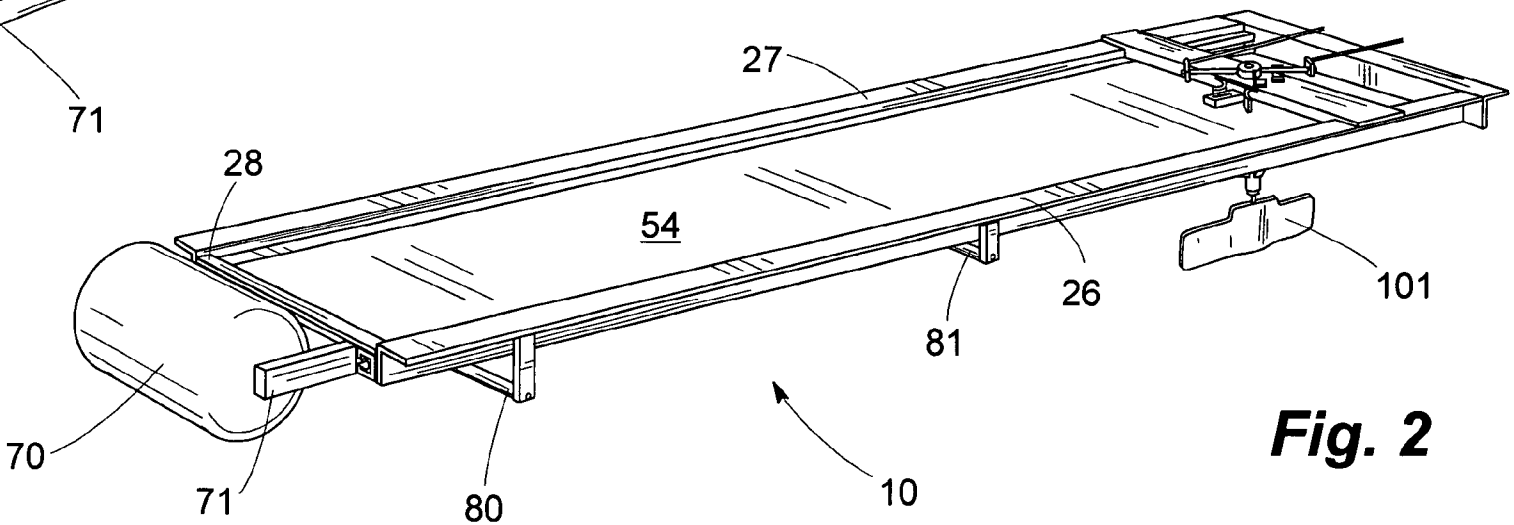
Figure 3:
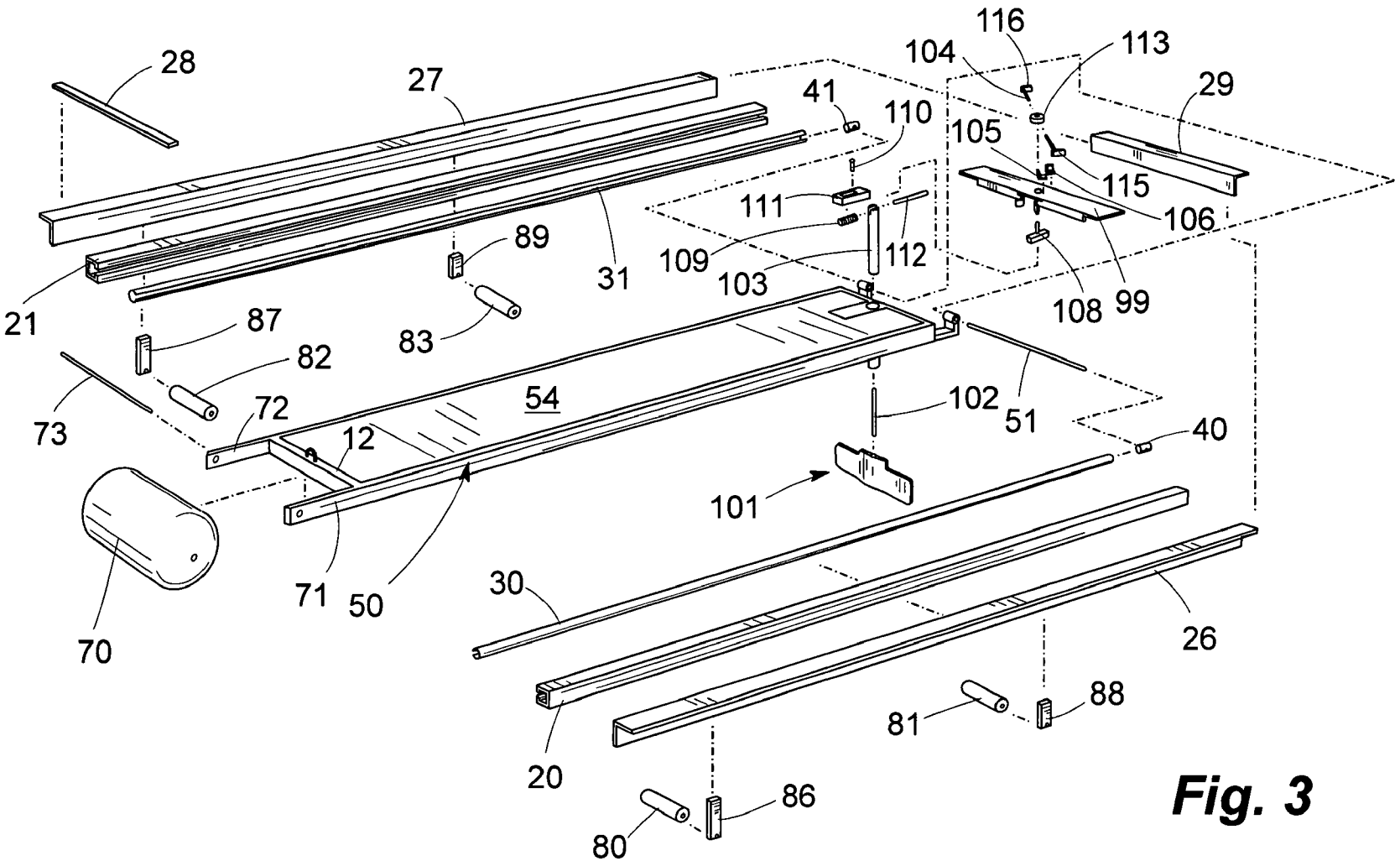
FIG. 3 is an exploded view of the ramp assembly according to FIG. 1, illustrating components of the ramp assembly ready for installation on a typical pontoon boat.
Figure 5:
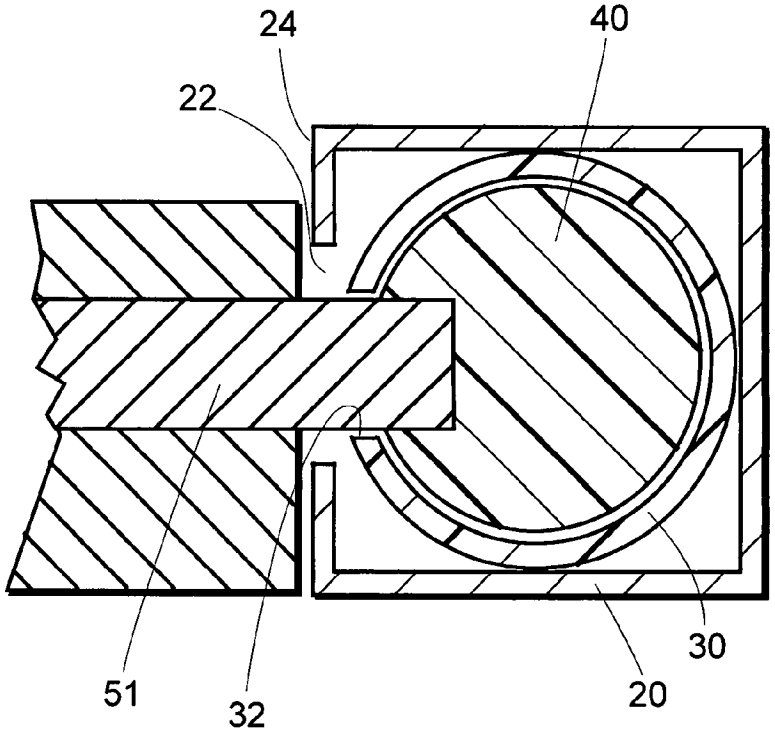
FIG. 5 is a transverse cross-section, on an enlarged scale, of fragmentary portions of the support structure and of the ramp, including a shaft mounted thereon which terminates in a bearing block, the bearing block being slideably received within a bearing surface track mounted within the support structure.
Figure 4:
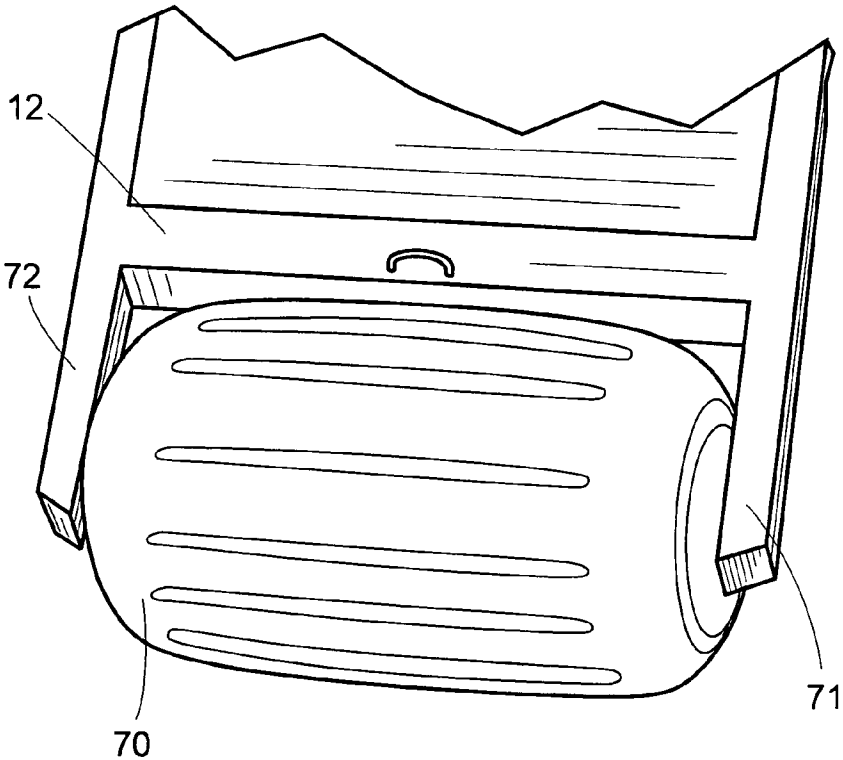
FIG. 4 is a closeup view, on an enlarged scale, of a fragmentary portion of the ramp assembly according to FIG. 1, showing the float and a pair of mounting brackets on the free end of the ramp.

In the drawings, an improved ramp assembly is indicated generally by the reference numeral 10. The ramp assembly 10 comprises a support structure 15 and a platform 50 (FIGS. 1-3). Distal ends of the platform 50 are supported by a shaft 51 and a float 70, which is rotatably mounted on an axle 73. The axle 73 is held in place by a pair of brackets 71, 72 (FIG. 3). Bearing blocks 40, 41, which are mounted perpendicularly to the shaft 51, suspend it and the platform 50, which is pivotally connected thereto, horizontally between rails 20, 21 (FIGS. 3 and 5). The rails 20, 21, together with angle members 26, 27 and cross members 28, 29, comprise the support structure 15 (FIGS. 1 and 3).

Preferably fabricated from square channel tubing, the rail 20 includes a wall 24 with an elongated slot 22 (FIG. 5). In the support structure 15, the slot 22 is aligned generally parallel with a similar elongated slot in the rail 21 (FIG. 3).

Mounted within each rail 20, 21, an elongated bearing surface track 30 defines a slit 32 which preferably extends the length of the track (FIGS. 3 and 5). As illustrated in FIG. 5, the slit 32 faces inwardly towards the contiguous slot 22 in the rail 20. Likewise, both the slit 32 and the elongated slot in the rail 21 are contiguous and face inwardly (FIG. 3).

In use, the bearing blocks 40, 41 slideably ride within the bearing surface tracks 30, 31, respectively (FIGS. 3 and 5).

Figure 6:
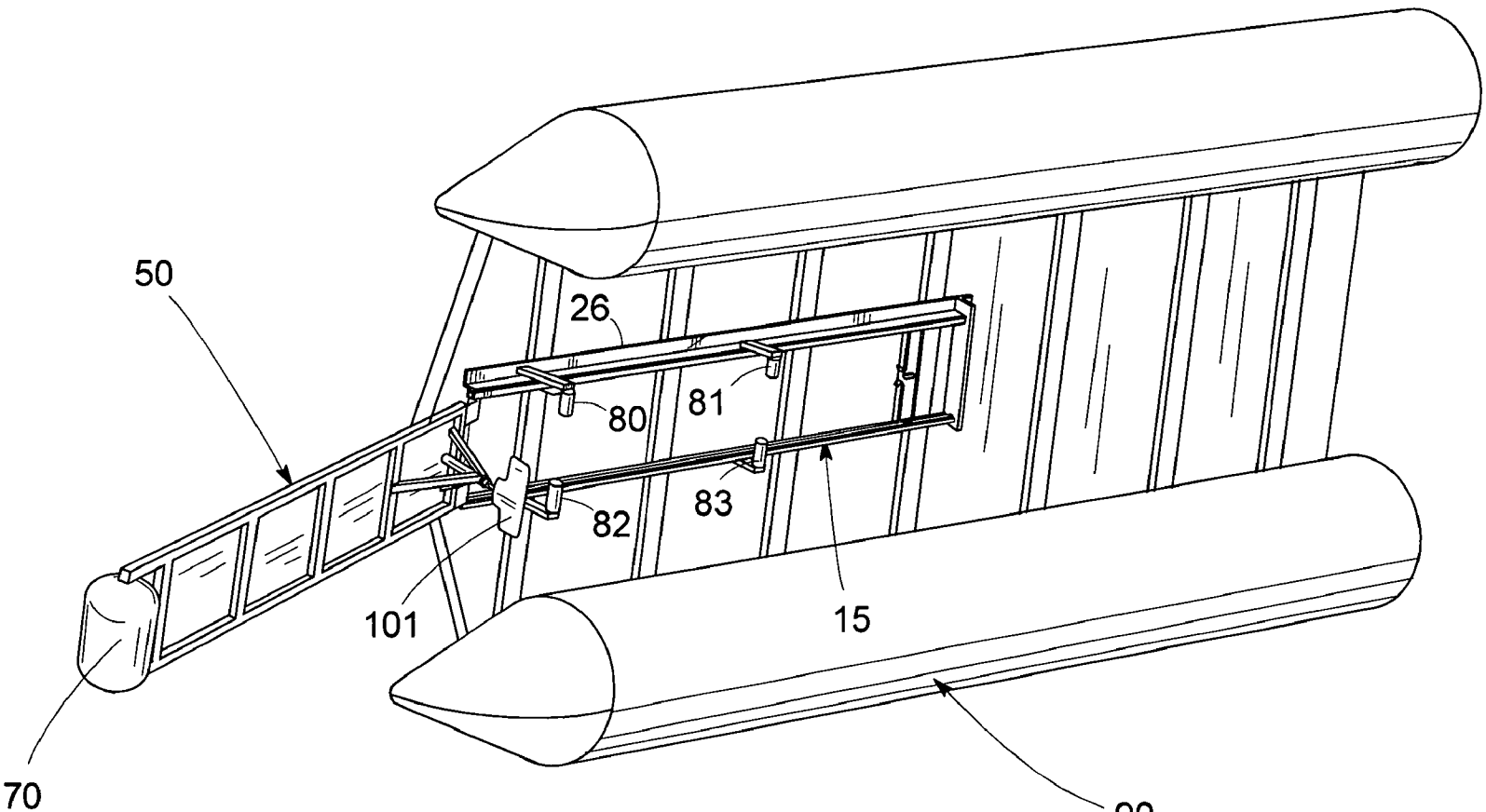
FIG. 6 is a perspective view of the underside of a pontoon boat on which the ramp assembly according FIG. 1 has been installed, the ramp being shown in a fully extended position, the pontoon boat forming no part of the invention.
Figures 7A, 7B:
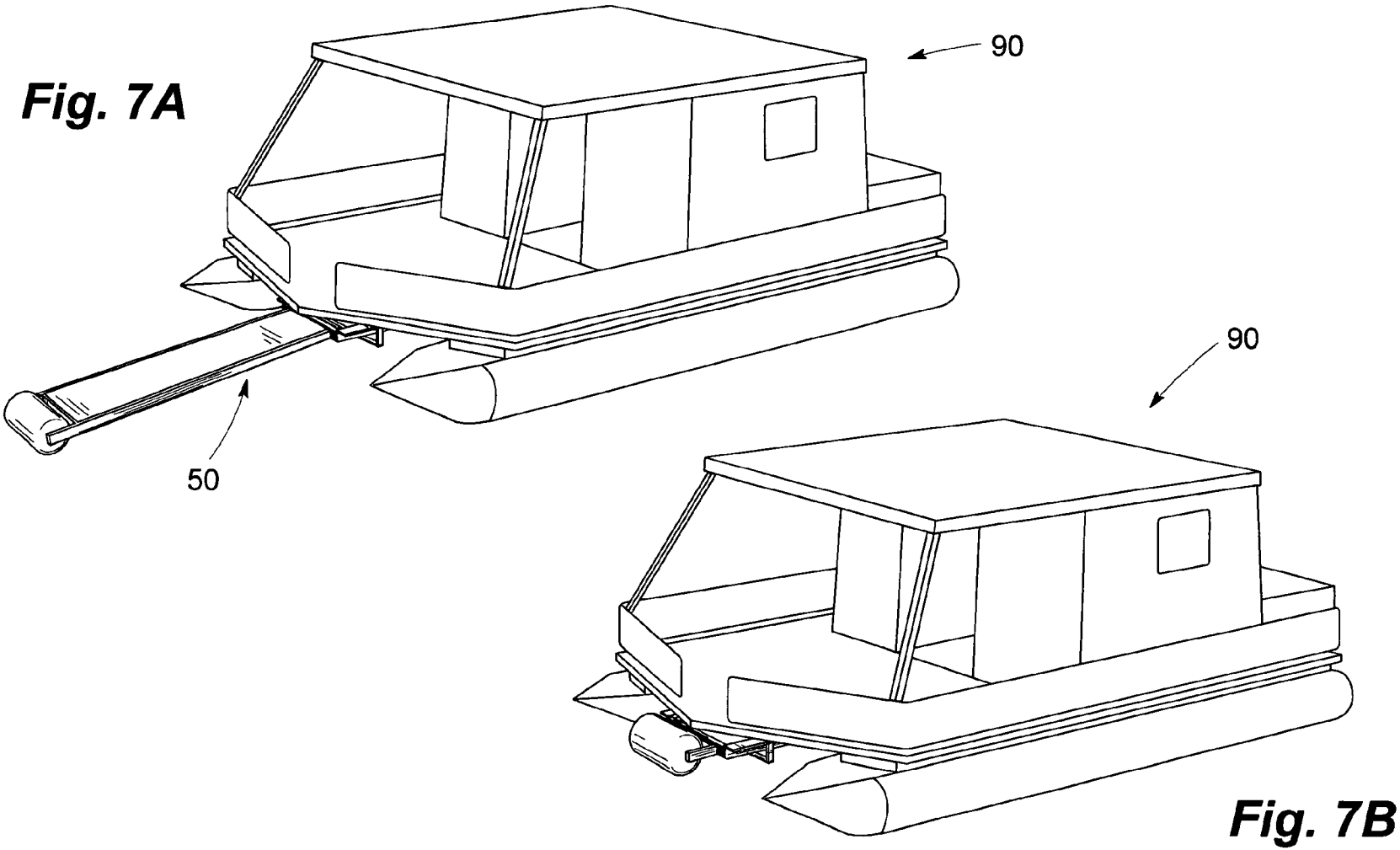
FIGS. 7A and 7B are perspective views of the topside of a pontoon boat on which the ramp assembly according FIG. 1 has been installed, the ramp being shown in extended and retracted positions in FIGS. 7A and 7B, respectively.

As one moves the platform 50 into its extended position, the bearing blocks 40, 41 slide rearward—relative to the front end of pontoon boat 90—within the elongated bearing surface tracks 30, 31 (FIGS. 3, 6 and 7A). Alternately, when the platform 50 is being retracted, the blocks 40, 41 slide forward.

In the platform 50, elongated side members, of which the brackets 71, 72 are forward extensions, and cross members 12, 13 comprise a generally rectangular frame to which sheet metal or the like is attached (FIGS. 1-3). The sheet metal is preferably covered with an exterior carpet 54 for extra safety.

Fitted between the brackets 71, 72, the cylindrical float 70 preferably has sufficient buoyancy to keep the aft end of the platform 50 above the water surface even when a user is standing on the platform. Easily rotatable about the axle 73, the float 70 also acts as a wheel for helping a user dock the platform 50 on a beach.

Means for stabilizing the platform 50 as it is being extended or retracted includes two pairs of guides 80, 81 and 82, 83 which are rotatably connected to vertical supports 86, 88; 87, 89, respectively (FIG. 3). The guides 80, 82 also support the outboard end of the platform 50 when the pontoon boat 90 is in dry dock. Vertical supports 86, 88; 87, 89 themselves are rigidly attached to angle members 26, 27 from which they extend downwardly (FIG. 3).

The platform 50 can be extended or retracted by a ramp rudder activation system 100 which comprises a rudder 101 supported on the lower end of shaft 102 rotatable in bearing 103 and a rudder control mechanism. By rotating control handle 104, the rudder 101 can be turned 90 degrees to the longitudinal centerline of the ramp. When the rudder 101 is so turned, the force of the water on the rudder while the boat is moving backward causes the platform 50 to extend. To retract the platform 50, the beat boat's direction is reversed; that is, the boat is propelled in a direction toward the outboard end of the platform.

The details of locking and unlocking the rudder 101 are as follows: While the ramp is in the stored position, the control handle 104. is temporarily connected to the upper end of the shaft 102 by a connector 113 which contains a key 108 (located below the shroud 99) that slideably fits into a groove at the top end 107 of the shaft 102. To extend the platform 50, the control handle 104 is rotated until it abuts the stop 105; in the process, the rudder 101 is also moved through approximately 90 degrees. (See FIG. 9A.) When the rudder 101 has been so rotated and simultaneously the boat 90 is driven backward, the force of the water on the rudder starts to extend the platform 50 . To lock the rudder 101 in the rotated position while the platform 50 is being extended, a pin 112 is pushed into the groove in the end 107 and held in place by a compression spring 109 in its housing 111. To keep the pin 112 from being ejected, a knob 110 is provided which rides in a groove in the housing 111.

Figure 8A:
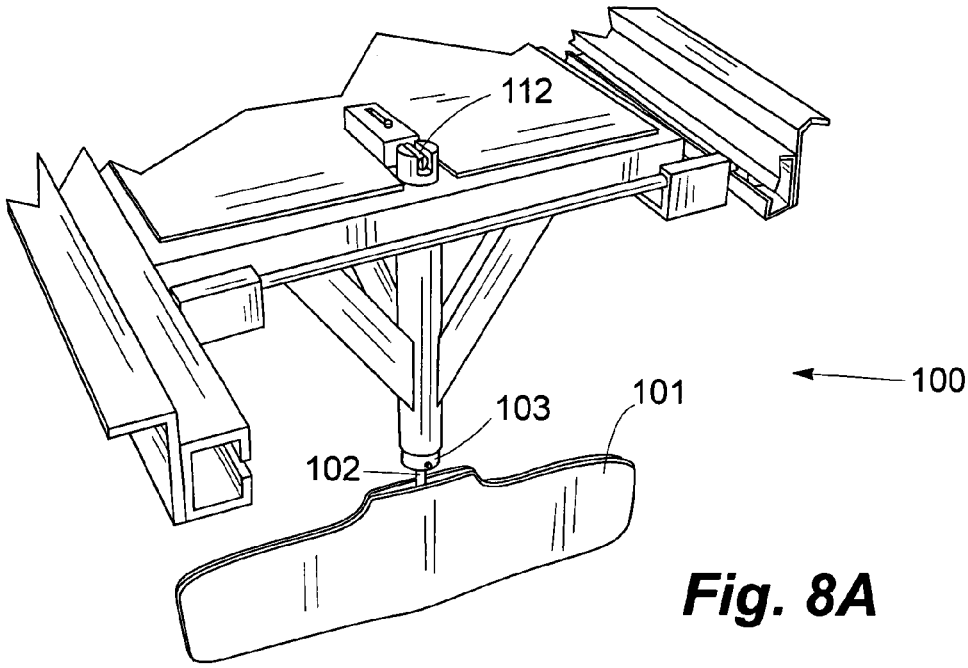
FIGS. 8A and 8B show closeup views of a ramp activation rudder in the ramp assembly according to FIG. 1, the rudder being shown in the active and inactive positions, respectively; the shroud, connector and control arm having been removed for clarity of illustration in FIG. 8A.
Figure 8B:
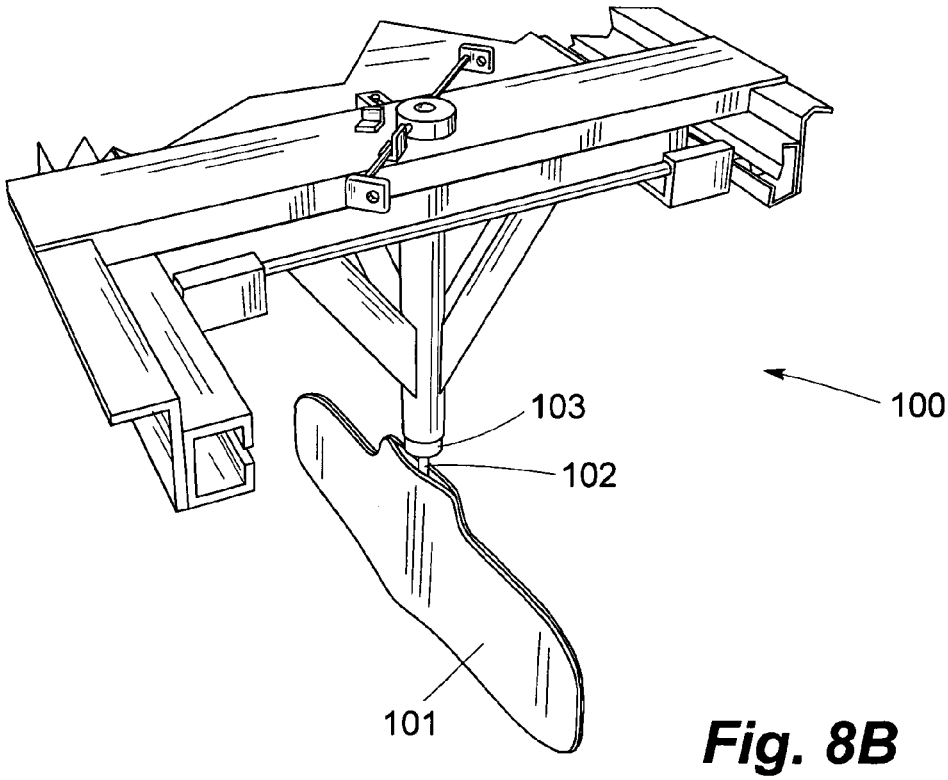
Figure 9A:
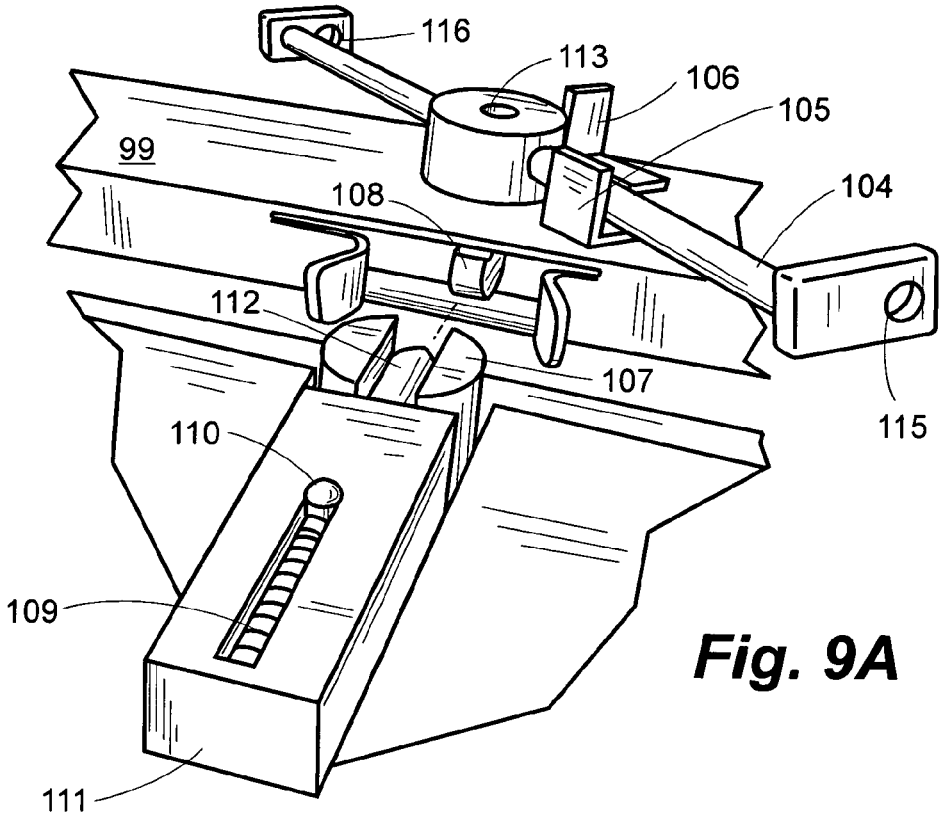
FIGS. 9A and 9B show closeup views of a ramp activation rudder control mechanism for the rudder according to FIG. 8B, the rudder control mechanism being shown in the unlocked and locked Positions, respectively.
Figure 9B:
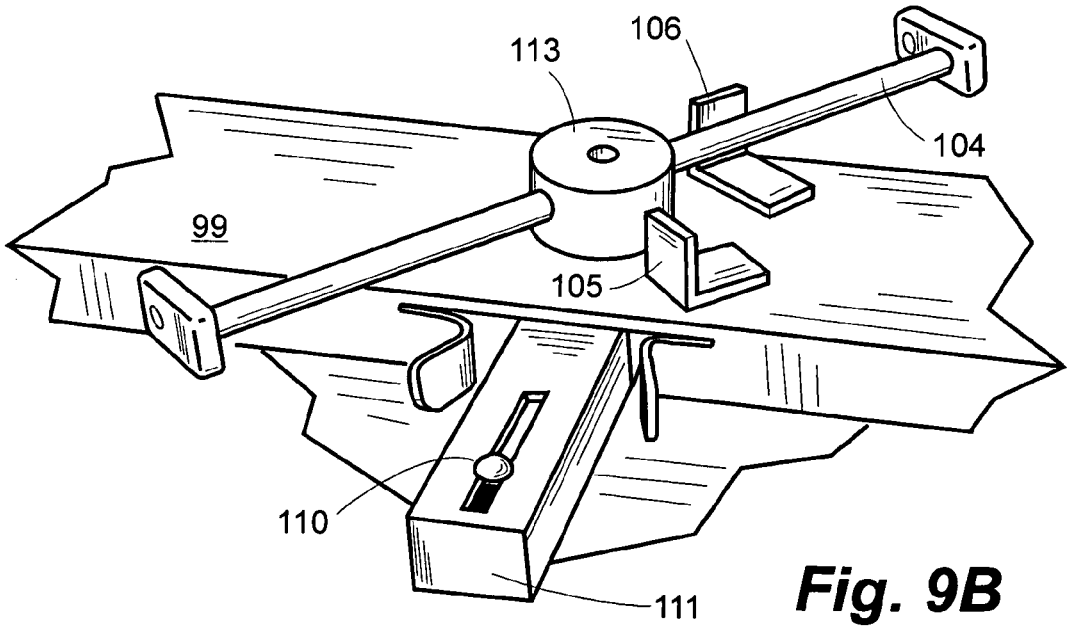
Figure 10A:
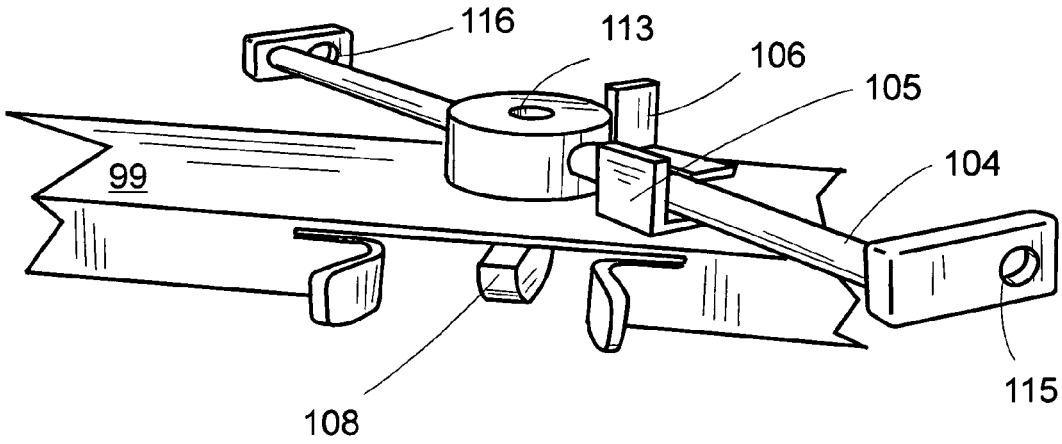
FIGS. 10A and 10B show closeup views of the ramp activation rudder control mechanism in the unlocked and locked positions, respectively.
Figure 10B:
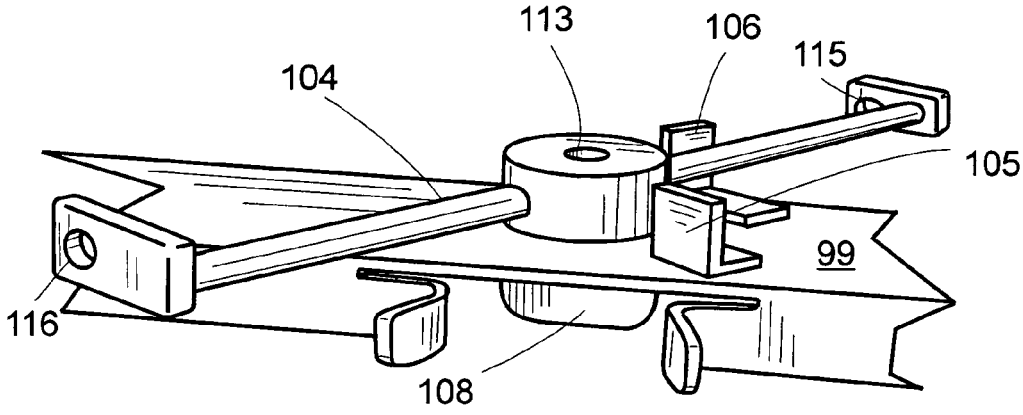

To store and lock the retracting platform 50, again refer to FIGS. 9A and 9B. As the platform 50 approaches its stored position, the key 108 comes into contact with the pin 112; and the pin is pushed out of the groove 107 (FIG. 9A). In this position, the handle 104 can then be turned from stop 105 to stop 106; and when the handle is so turned, not only is the rudder 101 moved from being disposed perpendicularly to the platform's longitudinal centerline to being aligned parallel with it but also the platform is locked in its stored position as shown in FIG. 8B.

Preferably, the control arm 104 and the knob 110 are located where they can be manually activated near the rudder; however, a system of ropes, cables, solenoids or the like can easily be devised to attach to holes 115, 116 on the ends of the control arm 104 so that the rudder control mechanism could be activated from any place on the boat.

In the prototype, the rails 20, 21 were fabricated from a pair of 2 inch square aluminum channels, each of which measures 8 feet long and has a wall thickness of ¼ inch. The elongated bearing tracks 30, 31 were made from Schedule 40, 1-½ inch O.D. PVC pipe. Generally cylindrical in shape and sized so that they can be slideably fitted within the elongated bearing tracks 30, 31, bearing blocks 40, 41 measure, by way of example, 1 inch in diameter and 2 inches in length. In this configuration, friction between the bearing blocks 40, 41 and the bearing surface tracks 30, 31 is sufficiently low that retracting the platform 50 requires one to exert a force of only about 10 pounds.

The platform 50 in the same prototype includes a frame fabricated from 1 inch square channel aluminum tubing and an ⅛ inch thick aluminum sheet. The latter is attached to and covers an approximately 2 foot by 8 foot section of the frame. Alternately, a platform fabricated of sheets of aluminum, fiberglass or the like between which are sandwiched a fill material, such as plastic foam, can be utilized.

In the prototype, the float 70 comprises a hollow cylinder, measuring approximately 8 inches in diameter and 20 inches long, which can be inflated for extra rigidity. A suitable float is Model No. 218HTM2W, manufactured by Taylor Made. Other floats which can be used in the ramp assembly 10 include those which have larger hollow cylinders, as well as floats filled with a plastic foam material.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A ramp assembly adapted for use with a pontoon boat, which comprises:

(a) a support structure having at least one elongated bearing surface track, the support structure being affixed to the underside of the boat in such a way that, in use, the bearing surface track extends generally horizontally;

(b) an elongated platform having an outboard end and an inboard end;

(c) a first shaft to which the inboard end of the platform is pivotally connected;

(d) means, including the first shaft and at least one bearing block connected thereto which slides within the bearing surface track, for slideably adjusting horizontal extension of the platform relative to the elongated bearing surface track;

(e) a floatable body mounted on the platform proximate with the outboard end, the floatable body having sufficient buoyancy to float itself and the platform when the platform is extended; and (f) means for extending and retracting the platform using the motion of the boat as it moves through the water, the platform being extended when the boat moves in the direction away from the outboard end, and the platform being retracted when the boat moves in the direction toward the outboard end.

2. The ramp assembly according to claim 1, wherein the means for extending and retracting the platform comprises a rudder and a second shaft attached thereto, the second shaft being rotatably connected to the platform, portions of the rudder distal from the platform penetrating the surface of the water during use, and which further comprises means for rotating the rudder through an angle of approximately 90 degrees in such a way that the rudder can be disposed perpendicularly to the longitudinal centerline of the platform, so that as the boat moves through the water with the rudder so disposed, the force of the water on the rudder causes the platform to move relative to the support structure.

3. The ramp assembly according to claim 2, which further comprises means for automatically holding the rudder in such a way that the rudder is disposed perpendicularly to the longitudinal centerline of the platform while the platform is being extended comprising an extendible pin and a receiving groove in the second shaft.

4. The ramp assembly according to claim 3, which further comprises a control arm having a key which fits into the receiving groove in the second shaft when the platform is fully retracted, movement of the control arm when the key is so fitted causing the rudder to rotate through an angle of up to approximately 90 degrees relative to the longitudinal centerline of the platform, so that the platform can be moved from its stored position to its extended position, the key also entering the groove so as to disengage the pin when the platform is nearly fully retracted and allow the control arm to be then used to turn the rudder until it is aligned generally parallel with the longitudinal centerline of the platform for storage.

5. The ramp assembly according to claim 4, which further comprises means for pulling on the control arm from a remote location in such a way as to turn the control arm.

6. An apparatus adapted for use with an elongated platform slideably connected to a pontoon boat, which comprises a rudder rotatably attached to the platform, the rudder including a blade with an elongated face, and means, including a mechanism which automatically locks the rudder, whenever the platform is partially retracted, in such a way that the elongated face of the rudder blade is disposed perpendicularly to the longitudinal centerline of the platform, for extending the platform forwardly from the boat using the motion of the boat to extend the platform as the boat moves backward through the water.

7. The apparatus according to claim 6, which further comprises a key connected to the boat, and means, including the key, for rotating the rudder through an angle of up to approximately 90 degrees relative to the longitudinal centerline of the platform, the key engaging the locking mechanism but only when the platform is at least nearly fully retracted.

8. An apparatus adapted for use with an elongated platform slideably connected to and extendible from a pontoon boat, which comprises:

(a) a rudder and a shaft attached thereto, the shaft being rotatably connected to the platform;

(b) an elongated key connected to the boat; and (c) means, including a groove defined by the shaft, for receiving the key when the key is aligned parallel with the longitudinal centerline of the platform and the rudder is disposed perpendicularly to said centerline, the key engaging the groove but only when the platform is at least nearly fully retracted.

* * * * *